United States Patent [19]

Barcell et al.

[11] 4,033,515

[45] July 5, 1977

[54] METHOD AND APPARATUS FOR REDUCING HAMMERMILL SLUGGING FOR LIVESTOCK FEED GRINDERS AND THE LIKE

[75] Inventors: Ernest A. Barcell, Lafayette; James L. Pusch, Golden, both of Colo.

[73] Assignee: Easy Engineering Corporation, Broomfield, Colo.

[22] Filed: July 10, 1975

[21] Appl. No.: 594,860

[52] U.S. Cl. ..... 241/27; 241/73; 241/101.7; 241/189 R

[51] Int. Cl.[2] ..... B02C 13/13

[58] Field of Search ..... 241/27, 73, 101.7, 186 R, 241/186.2, 189 R

[56] References Cited

UNITED STATES PATENTS

| | | | |
|---|---|---|---|
| 3,436,028 | 4/1969 | Koehnen et al. | 241/186 R |
| 3,743,191 | 7/1973 | Anderson | 241/73 |

*Primary Examiner*—Granville Y. Custer, Jr.
*Attorney, Agent, or Firm*—John E. Reilly

[57] ABSTRACT

Reduction or loss of rotary hammermill grinding action for a tub grinder is prevented by effectively extending the surface of the floor of the tub grinder across the gravity feed opening for the hammermill chamber area. In one form, the floor extension includes a plurality of relatively narrow cross-bars which extend completely across the chamber opening in the floor so as to block relatively heavy or dense clumps of unground feed from resting on the hammermill discs or jamming between the hammermill and its chamber sidewalls. The pivoted hammers are permitted to rotate in an arc extending above the cross-bars. In another form, the tub floor extension is formed by a multiplicity of generally triangular shaped members which extend from the feed side of the opening across the opening with sufficient distance to prevent jamming against the hammermill discs while providing sufficient vertical support to allow initial grinding of such dense clumps by the pivoting hammermill hammers. An additional improvement feature employs a deflection plate on the opposite side of the hammermill opening to redirect ground feed materials impelled upwardly out of the aperture in a direction so that they will be retained by the tub.

10 Claims, 5 Drawing Figures

METHOD AND APPARATUS FOR REDUCING HAMMERMILL SLUGGING FOR LIVESTOCK FEED GRINDERS AND THE LIKE

CROSS-REFERENCE TO RELATED APPLICATION

Copending application Ser. No. 539,821 entitled ADJUSTABLE SWEEPING APPARATUS FOR FEED GRINDERS AND THE LIKE, by Ernest A. Barcell which was filed on Jan. 9, 1975 and assigned to the same assignee as the present application illustrates a feed grinder somewhat similar to that described in this application.

BACKGROUND OF THE INVENTION

The present invention relates to apparatus for grinding materials such as livestock feed. More particularly, the present invention relates to improved livestock feed tub grinders which employ rotary hammermills to effect grinding of feed materials introduced to the hammermill section or chamber via gravity feeding through an aperture in the tub floor. The present invention is especially useful as a feed grinder for chopping and loosening compacted feed materials so as to enhance the handling, mixing and consumption characteristics of livestock ration.

Crops intended for livestock feed such as hay and the like are generally harvested into compact bales for ease of handling and storage. The compactness of such bales not only makes it difficult to mix the materials with grains, silage or other types of feed as needed for accurately balanced rations but is also more difficult for the livestock to consume. Further, the compactness of such bales causes greater wastage of the feed from trampling and scattering by the livestock. Accordingly, various devices have been developed for grinding the bales of livestock feed so as to loosen it and break up clumps thereof into sizes more easily handled by the livestock. Such prior art devices frequently employ a rotating hammermill located below a tub-like container so as to be fed through an aperture in the bottom floor of the container. The sidewalls of the tub grinder container are rotated so as to urge the feed materials over the aperture for gravity introduction to the hammermill chamber. The hammermill itself generally is composed of a plurality of discs which are arrayed along a drive shaft and coupled to a prime mover apparatus for rotary motion. The discs are interconnected by a plurality of spaced bars on which are mounted a series of blade-like hammers for relatively free pivotal movement. Thus, the discs are intended to be rotated at a relatively constant angular velocity, while the freely pivoting hammers impact the feed to be ground and impart a grinding and cutting operation thereon.

Although rotary hammermill tub grinders for livestock feed have been in use for some time, various problems associated with urging the materials in a rotary direction within the tube have been encountered. One arrangment for reducing the so-called bridging effect of such feed materials over the aperture of the hammermill chamber is shown in cross-referenced copending application Ser. No. 539,821 by Barcel. Despite improvments to the rotary feeding within the tub as provided by the cross-referenced Barcell invention, problems have still remained resulting from heavy and tightly compacted unground material jamming against the hammermill thereby slowing or stopping it and effectively preventing grinding of the feed. This is sometimes referred to as a slugging problem which has two essential aspects.

First, the rotary hammermill is generally positioned within a basket-like screen container which is attached below the tub floor aperture. Thus heavy and compact clumps of unground material can fall into the chamber defined by this screen thereby wedging between the discs and the container. The result is a braking effect to the hammermill so as to substantially reduce or stop its rotation. Another aspect of the slugging problem is the downward pressure by the compacted bales against the tops of the discs of the hammermill which likewise can act as a brake to the hammermill rotation. The slugging of the hammermill need not completely stop rotation of the disc but, if sufficient to prevent pivoting of the hammer elements, is still effective for stopping or significantly reducing any grinding of the feed materials. One arrangement for attempting to overcome this slugging problem is shown in U.S. Pat. No. 3,743,191 by Anderson wherein a series of fixed fingers extend downwardly into the aperture chamber. This apparatus is partially effective for preventing the wedging of materials between the chamber screen and the hammermill discs. However, apparatus such as the Anderson device do not prevent compacted bales from resting upon the upper portion of the hammermill disc thereby reducing hammer rotation and grinding effectiveness. Still further, the downwardly projecting fixed fingers of Anderson-type devices require acceptance of a reduced number of pivoted hammer elements in order to retain sufficient spacing so as to prevent interference between the hammers and the fixed fingers.

SUMMARY OF THE INVENTION

The present invention provides a method and apparatus for significantly reducing the slugging problem associated with tub grinders for livestock feed grinding and the like. Typical such tub grinders include an open cylindrical container which is mounted to a base structure or chassis for rotary motion to impart rotary movement to the unground materials. These materials are directed over an aperture in the floor of the container so as to drop into a hammermill chamber by gravity. The invention contemplates effectively extending the surface of the tub floor so as to support the unground materials in a manner which will prevent reduction of the rotary motion of the hammermill.

In one form of the invention, the floor surface extension is effected by employing cross-bars extending across the hammermill opening so that dense or thick clumps of unground material will be supported clear of the hammermill discs but in a position to permit their impacting by the pivoted hammers. In another form of the invention, a plurality of stub fingers of a generally triangular shape are arrayed along the edge of the hammermill aperture which is initially encountered by the rotating unground material. These triangularly shaped fingers are arranged so that a relatively narrow upper surface thereof extends from this leading edge of the aperture and across the aperture with a sufficient distance so as to provide initial support of clumped material in a manner which prevents its entry into a wedging relation between the hammermill enclosure screen and the hammermill discs. The lower edge of the triangular stub fingers is positioned so as to be above the arc of rotation of the freely pivoting hammer elements thereby permitting usage of the maximum number of such hammer elements and further removing the need for relatively close positioning tolerances as would be required if the stub fingers were positioned below the arc of the hammer element.

Another problem which has been encountered by tub grinders relates to the geysering effect of the ground material which is impelled upwardly out of the aperture by the rotating hammermill. Such geysering causes loss of the ground material by escape from the container and is particularly evident when the contents of the cylindrical container is relatively low. By including a deflecting guide plate on the exit side of the hammermill aperture, the ground material impelled upwardly by the hammers can be directed back into the container thereby reducing loss.

An object of this invention is to provide an improved rotary tub grinder particularly useful for reducing the slugging effect caused by compact livestock feed and the like.

Another object of the present invention is to reduce or prevent the slugging problems associated with hammermills in rotary tube grinders.

A still further object of this invention is to provide an effective floor extension for a rotary tub grinder apparatus so as to prevent braking associated with the bearing of unground materials against the hammermill elements.

Still another object of this invention is to extend the continuous operability of rotary tube grinders.

A still further object of this invention is to reduce the loss of materials from a tub grinder which includes a rotary hammermill.

The foregoing and other objects, features and advantages will be readily apparent from the following detailed description of exemplary preferred embodiments taken in conjunction with the accompanying drawings.

DETAILED DESCRIPTION OF THE PREFERRED EMBODIMENTS

Figure 1:
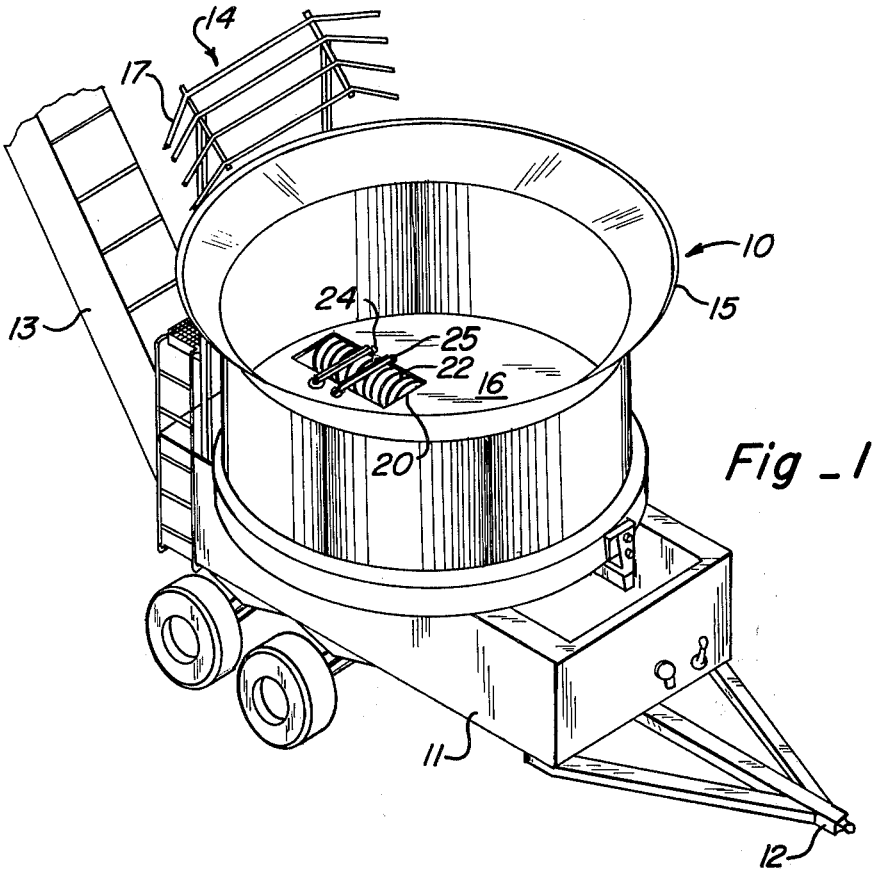
FIG. 1 is a perspective view of a typical mobile rotary tube grinder including modification in accordance with one form of the preferred embodiment.

FIG. 1 shows an overall perspective view of a tub grinder 10 which is wheel-mounted for movement by another vehicle [not shown]. A main frame or base structure 11 has a yoke arrangement 12 on one end for attachment to a vehicle and an endless belt chute 13 extending outwardly from the other end. Typically, chute 13 is vertically adjustable so that materials which have been ground can be delivered to an appropriate destination.

A cylindrical open topped tub-like container 15 is attached to main frame 11 in such a manner as to permit circular rotation of tub 15 about its central axis. The base structure 11 includes prime mover apparatus for imparting this rotary motion to tub 15 which can be effected via a self-contained power system or via a power take-off from another vehicle. A framework 14 is rigidly attached to base structure 11 with the central portion overhanging the upper opening of tub 15. The ends such as 17 of the horizontal members of guide frame 14 are angled outwardly from tube 15 to intercept any loose materials which might be hanging outside of the tub and urge that material into the tube opening.

The lower diametric end of tub container 15 is effectively enclosed by floor plate 16 which is retained in fixed relation to the base structure 11. A hammermill is contained below aperture 20 which extends in a radial direction across the upper surface of floor 16 and contains hammermill elements as will be described in greater detail below. Various means of imparting rotary motion to tub 15 are known, a detailed example of one such an arrangement being shown in the cross-referenced Barcell application Ser. No. 539,821. Note that the rotary motion of tube 15 is intended for the purpose of rotationary churning of materials to be ground within the container and over fixed floor plate 16 so as to provide gravity feeding through aperture 20. This rotary churning can be augmented by the addition of positionable sweeping plates as described in detail in the cross-referenced Barcell application Ser. No. 539,821 if desired. The rotary hammermill 22 is positioned below aperture 20 and the surface of floor plate 16 is effectively extended across aperture 20 via cross bars 24 and 25.

Figure 2:
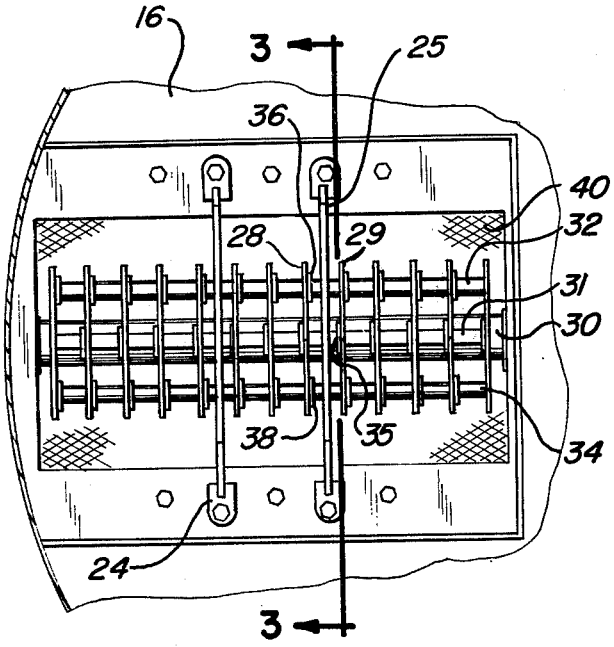
FIG. 2 is a top plan view of the hammermill section of a rotary tube grinder as generally shown in FIG. 1.
Figure 3:
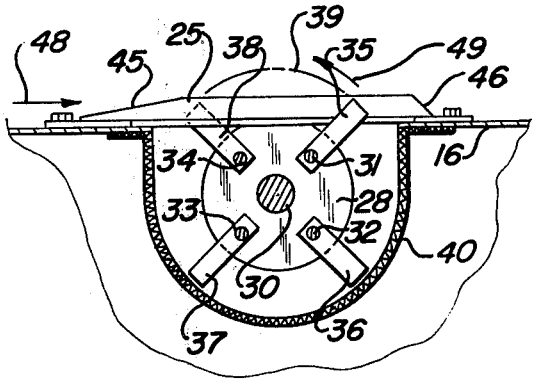
FIG. 3 is a section view taken along the line 3—3 of FIG. 2 with the hammers rotated 45° as compared to FIG. 2.

The details of the hammermill section and the advantageous implementation of cross bars 24 and 25 can be best seen in FIG. 2 and FIG. 3. FIG. 2 illustrates the hammer elements as seen from above when in a quiescent or downward hanging state whereas FIG. 3 is a section view taken along lines 3—3 of FIG. 2 except with hammermill 22 rotated by 45° and the hammer shown in full outward pivoted relation to more clearly show the interrelationship of the elements. A plurality of discs such as 28 and 29 are journaled to a central shaft 30 so as to be rotated about shaft 30 by a prime mover [not shown]. Note that FIG. 3 is a section view to the immediate left of disc 29 but to the right of hammer elements 35 and 37 in FIG. 2 looking towards bar 25 and disc 28 as is apparent from the direction indicating arrows associated with section line 3—3 of FIG. 2. The discs are interconnected by a plurality of cross rods 31–34 [not FIG. 3] which extend in parallel relation to drive shaft 30 but axially offset with respect thereto. As shown in the example of FIGS. 2 and 3, each of the interconnecting bars 31–34 retain a hammer element between each adjacent pair of discs [i.e.: hammers 35–38 between 28 and 29] in a freely pivotal relation therearound. As shown in FIG. 2, the hammers 35–38 are attached to interconnecting bars 31–34 in an alternating arrangement such as by suitable spacer collars on bars 31–34 so that the area impacted on the materials to be ground by the hammers is increased. The hammers 35 and 37 are arranged so as to pivot on opposite sides of cross bar 25 from hammers 36 and 38. The arc of pivotal rotation of hammers 35–38 is as shown by the dotted line 39 and extends above the cross bars 24 and 25.

The cross bars 24 and 25 support the weight of dense compacted materials clear of the rotating discs such as 28 and 29 while allowing such materials to be impacted by the pivoting hammers 35–38 thereby breaking up the clumps. Further, the compact or dense clumps will be prevented from wedging between enclosing screen 40 and the discs of the hammermill. Impedance of rotary movement of the materials within tub 15 by the cross bars 24 and 25 can be reduced by employing a sloped initial surface such as 45 for cross bar 25 shown in FIG. 3. It has been found that a relatively shallow angle to the horizontal such as 30° or less is satisfactory for most normal grinding. However, an additional sloped face 46 on the other end of the cross-bars can be included at a steeper angle such as about 45°. Thus when heavier grinding operations are encountered which tend to overload the mill, the cross-bars can be reversed across opening 20 or alternatively the rotary direction of tub 15 and mill 22 can be reversed. This will permit faster lifting of the material to be ground and further reduce slugging or mill overloading.

Note that the materials to be ground are assumed in the example shown to be feeding in the direction of arrow 48 and the rotation of the hammermill 22 is assumed to feed in a counterclockwise direction as shown by arrow 49. Thus, by including an appropriate number of cross bars such as 24 and 25 arrayed so as to effectively extend the surface of the floor plate 16 as is shown in the exemplary embodiment of FIGS. 2 and 3, minimal impedance to material flow will result while the rotary mill will not be blocked from rotational movement by wedging between screen 40 and the discs nor by dense bales resting downwardly on the discs.

Figure 4:
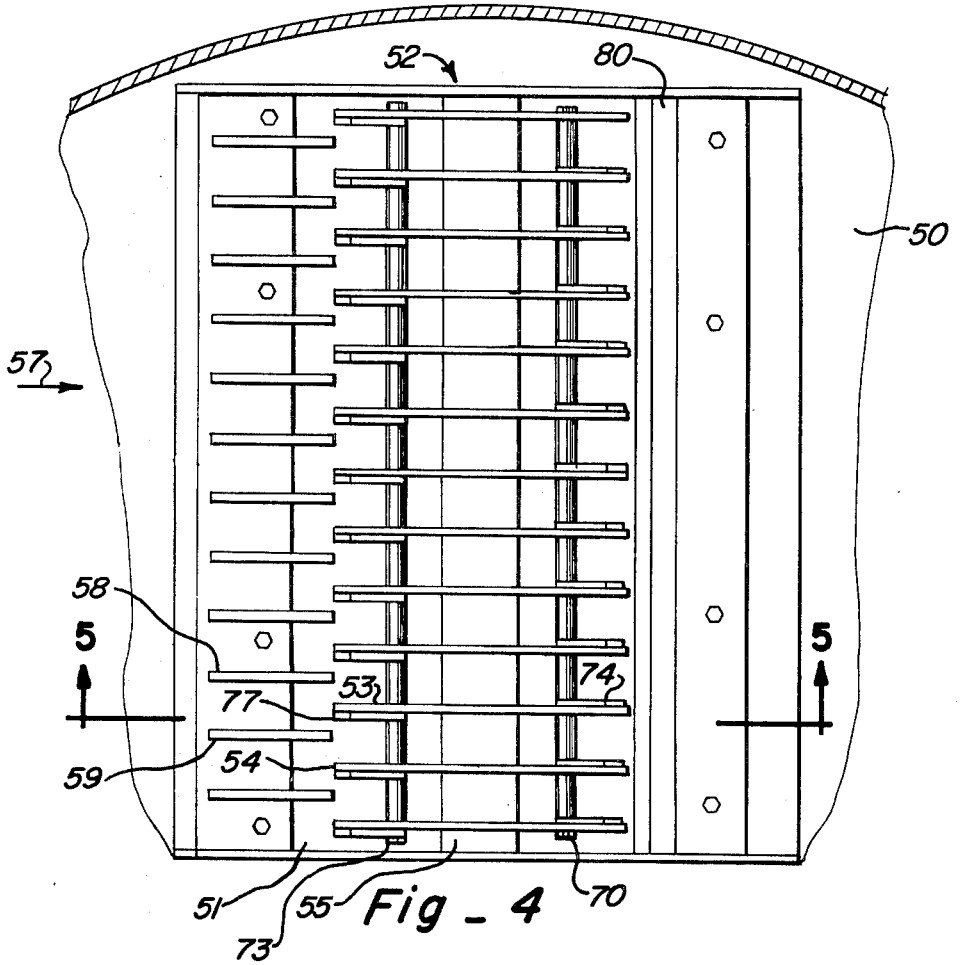
FIG. 4 is a top plan view of a rotary tub grinder hammermill opening illustrating another form of preferred embodiment of this invention.

Another form of the preferred embodiment is illustrated in FIGS. 4 and 6, the latter being a section view taken along lines 5—5 in FIG. 4. In this embodiment, floor 50 has an aperture 51 opening radially therethrough and a rotary hammermill 52 somewhat like that described previously is positioned below aperture 51. As with the FIGS. 2 and 3 embodiment, the hammermill includes a plurality of discs such as 53 and 54 which are journaled to a drive shaft 55 coupled to a prime mover apparatus [not shown] for effecting rotary motion in the direction indicated by arrow 56 of FIG. 5. The materials to be ground are assumed to be fed in the direction of arrows 57 by the churning motion of the tub sidewalls as mentioned above. A plurality of triangularly shaped stub fingers such as 58 and 59 are arranged so as to effectively continue the surface of the tub floor 50 over the opening between the arc of the hammermill rotations as indicated by dotted line 60 and the enclosing open mesh type screen 61 which define the hammermill chamber.

Figure 5:
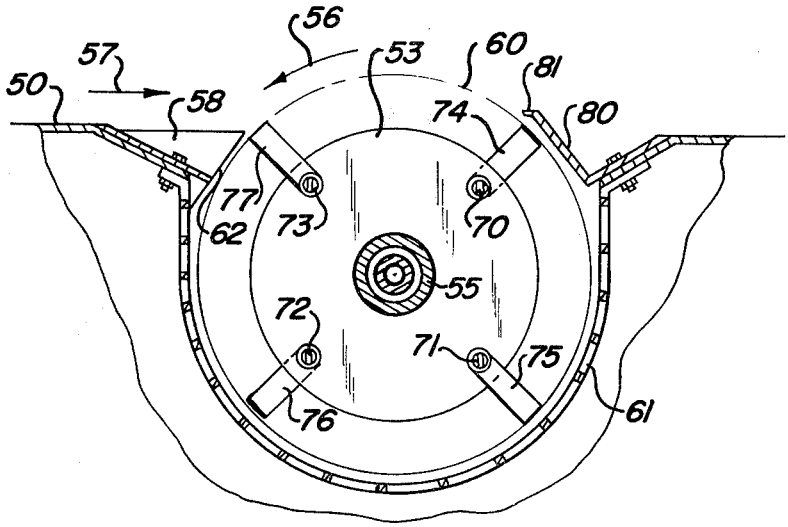
FIG. 5 is a section view taken along the line 5—5 of FIG. 4.

The hammermill arrangement of FIGS. 4 and 5 as with FIGS. 2 and 3 includes a plurality of interconnecting rods 70–73 each of which has a freely pivotal hammer element 74–77 attached thereto.

In any event, the configuration of FIGS. 4 and 5 is similar to FIGS. 2 and 3 in that the hammer elements such as 74 and 77 are mounted in somewhat offset relation to each other so as to provide slashing at alternate area of the material as the mill rotates. That is, suitable spacer collars or guide grooves on pivot bars 70–73 can be included to position the hammers in offset relation as can best be seen in FIG. 4. The advantage of the invention as illustrated in FIGS. 4 and 5 is that braking of the hammermill 52 via wedging effects between the discs and the enclosing screen 61 is prevented but the maximum number of pivoting hammer blades such as 74–77 can be included. That is, by insuring a minimal clearance between the outer arc 60 of the hammer elements and the lower surface of the triangular wedge-shaped elements such as surface 62 of stub finger 58, the number of hammer elements need not be reduced while still obtaining the benefits of reduced feed material braking of the hammermill rotation. Still further, the mechanical tolerances to insure no interference between the pivoting hammer element and the stub fingers is effectively removed by this arrangement.

A deflector plate 80 is also illustrated in FIGS. 4 and 5 for the purpose of directing ground materials which are impelled upwardly by pivoting hammer elements 74–77 out of aperture 51 in a manner so that they are returned to the container rather than being directed upwardly and hazarding loss from escape from the tub container. Preferbly deflector plate 80 extends so as to correspond to a portion of the upper arc 60 of the hammers as shown but not to the extent that plate 80 could significantly impede rotary movement of the feed. The outer edge 81 of plate 80 can be somewhat horizontally directed as is evident in FIG. 5 so as to further augment the material deflection operation.

In operation, the compacted livestock feed which is to be ground is introduced to tube 15 such as by a conveyor, front-end loader or the like. Power is then applied to the cylindrical sidewalls of tub 15 to urge the materials in a rotary churning motion over fixed floor 16. Rotary power is likewise applied to the hammermill drive shaft so that the freely pivoting hammers swing upwardly in an arc extending above the surface of the tub floor and preferably in a direction in opposition to the rotary churning movement of the compacted feed. The prime mover for the tub and the hammermill can be a common source such as a power takeoff from another vehicle or from an independent power source contained within the base structure 11. The power source is suitably coupled to the tub and hammermill such as by a selectable belt drive, hydraulic drive or the like and can be arranged such that either the hammermill or the tub or both are powered at any one time.

In any event, the compacted feed is supported as it passes over the gravity feed aperture over the hammermill grinder section with this support being effectively provided as an extension of the plane of the tub floor so as to prevent slugging or braking of the hammermill rotation while retaining the feed materials in a position which permits impacting thereof by the rotating hammers. The feed materials that have been sufficiently chopped are then impelled downwardly against the screen enclosure which permits passage therethrough of materials of sufficiently small proportions for removal by endless belt conveyor 13. Materials too large to pass through the open mesh of screen 40 are continuously flailed by the hammers as they pass between the screen and the discs until sufficiently reduced in size to pass through the screen or are returned to the tub for re-feeding into the hammermill section.

In a typical configuration suitable for most livestock feed grinding uses, the tub has a seven and one-half diameter for the lower section and a ten foot diameter for the upper or flared section. The tub is typically driven between zero and eight RPM. The total overal tub height is four feet four inches with the slot or aperture opening into the hammermill section being 42.5 inches long by 23.5 inches wide. The hammermill drive shaft [30 in FIG. 3 and 55 in FIG. 5] is three and seven sixteenths inches in diameter driven at abou 2000–2100 RPM and the discs are typically thirteen and seven-eighths inches in diameter of 5/16th incl hard-rolled steel. The discs are spaced about three and one-quarter inches apart on centers along the drive shaft. The hammer mounting bars are approximatel 5/16th inch diameter and the hammers are typically 7 ⅝ths inches long with a one-inch diameter mounting ole so as to provide about a 5 to 6 inch hammer swing. 'he hammer mounting bars such as 31—34 in FIGS. 2 nd 3 and 70–73 in FIGS. 4 and 5 are positioned on a 0 ¼ inch diameter circle relative to the central axis of he drive shaft.

For the cross bar version illustrated in FIGS. 2 and 3, he typical cross bars are of ⅝ths inch wide hard-rolled teel with a maximum height of 2 inches and an overall ength of 26 inches. The face sloped at one end is at bout 30° angle from horizontal and the other end at bout 45°. The number of such cross bars depends pon the intended usage but is has been found that two ross bars across the opening are satisfactory for most ormal usage of the grinder. That is, the use of two ıore or less equally spaced cross bars is optimum for ıinimum impedance to the hammermill feeding while ırther providing the necessary support to prevent lugging or reduction in hammermill grinding speed.

The stub fingers such as 58 and 59 shown in FIGS. 4 nd 5 are typically of ¾th inch hard-rolled steel with an verall horizontal extension on the upper surface of 7 ıches. A typical installation of these fingers includs a orizontal extension above the lower apex of 2 inches nd a vertical distance from that apex of about 2 ½ ıches. A typical hammermill installation will include ıirteen discs with twelve stub fingers generally aligned quidistant between each disc. Hard-rolled steel is pre- erred for all elements in both versions.

Although the present invention has been described 'ith particularity relative to the foregoing exemplary mbodiments, various additions, modifications, hanges and applications other than those specifically ıentioned will be readily apparent to those having ormal skill in the art without departing from the spirit f this invention.

We claim:

1. A method for grinding livestock feed and the like, omprising the steps of:

introducing the feed into a hollow container having an opening in the lower floor thereof for communicating with a hammermill contained within a chamber below the floor, imparting a rotary motion to the feed along the lower floor surface so that it passes over the floor opening and drops into the hammermill, supporting the feed over the opening in the plane of the surface of the lower floor by extending the floor surface across the opening at a plurality of narrow sections extending transversely of the opening and generally parallel to the movement of the feed in response to said rotary motion imparting step so that large clumps of the feed will not jam between the hammermill and its chamber, and pivoting hammers of the hammermill in arcs extending above the surface of the floor for breaking up relatively dense clumps supported above the hammermill.

2. A method in accordance with claim 1 which fur- ıer includes the step of deflecting material impelled ıt of the opening by the pivoting hammers back into ıe hollow container.

3. In an apparatus for grinding materials such as 'estock feed and the like which has a base structure ith a prime mover and hollow cylindrical container ounted on the base structure with the central axis of ıe container being vertical to the base structure, the container being rotatably driven by the prime mover for urging materials in the container in a rotary direction, the combination comprising:

a horizontal floor plate attached in fixed relation to the base structure for enclosing the lower diametric end of the cylindrical container and including an elongated aperture therethrough extending in a radial direction, a grinding mill including a plurality of discs connected to a prime mover for rotary motion about a common axis, a plurality of bars for interconnecting said discs in locations parallel to be in axially offset relation to said common axis, a plurality of elongated hammers attached for freely pivoting about said bars in an arc extending beyond the peripheral edges of said discs, and an arcuate screen underlying said discs and hammers as an enclosure therefor below the surface of said floor plate, said grinding mill being mounted below said floor plate aperture for gravity feed of materials thereinto with said discs' common axis being radially oriented relative to said floor plate, the upper peripheral edges of said discs being positioned in proximity to the surface of said floor plate while at least the uppermost point of the arc of rotation of said hammers being above the surface of said floor plate, and support means comprising a plurality of narrow sections extending transversely of said aperture, each said narrow section having opposite ends attached on opposite sides of said aperture perpendicular to the common axis of said discs, said support means having an upper edge extending in a generally tangential orientation with respect to rotary movement of materials in the container for preventing dense clumps of material from wedging between said discs and said enclosing arcuate screen.

4. In an apparatus in accordance with claim 3, said narrow sections defined by a plurality of cross bars each having the ends thereof attached on opposite sides of said aperture.

5. In an apparatus in accordance with claim 2, each said cross bar being positioned between two of said discs so that the arcs of successive hammers attached between said two discs alternately pass on opposite sides of the associated said cross bar.

6. In an apparatus in accordance with claim 4, each said cross bar having a sloped end surface extending in a converging direction relative to the surface of said floor plate so that the narrowest portion of said cross bars are along the edge of said aperture initially encountered by materials which are in rotary movement in response to rotation of the container.

7. In an apparatus in accordance with claim 4, each said cross bar having a vertically oriented generally rectangular cross section throughout the central portion thereof and having downwardly sloped faces along each end of the upper surface thereof.

8. In an apparatus in accordance with claim 7, said downwardly sloped face on one end being at approximately 30° with respect to the surface of said floor plate and said downwardly sloped face at the other end being at approximately 45° with respect to the surface of said floor plate, said cross bars being attachable to said floor plate so that the said end face first encountered by materials moving in the container is said one end face for normal grinding and is said other end face for grinding of relatively dense materials.

9. In an apparatus for grinding materials such as livestock feed and the like which has a base structure with a prime mover and hollow cylindrical container mounted on the base structure with the central axis of the container being rotatably driven by the prime mover for urging materials in the container in a rotary direction, the combination comprising:

a horizontal floor plate attached in fixed relation to the base structure for enclosing the lower diametric end of the cylindrical container and including an elongated aperture therethrough extending in a radial direction, a grinding mill including a plurality of discs connected to a prime mover for rotary motion about a common axis, a plurality of bars for interconnecting said discs in locations parallel to but in axially offset relation to said discs' common axis, a plurality of elongated hammers attached for freely pivoting about said bars in an arc extending beyond the peripheral edges of said discs, and an arcuate screen underlying said discs and hammers as an enclosure therefor below the surface of said floor plate, said grinding mill being mounted below said floor plate aperture for gravity feed of materials thereinto with said discs' common axis being radially oriented relative to said floor plate, the upper peripheral edges of said discs being positioned in proximity to the surface of said floor plate while at least the uppermost point of the arc of rotation of said hammers being above the surface of said floor plate, and support means attached in fixed relation to said floor plate along the edge of said aperture which is initially encountered by the materials moving in response to urging by the container, said support means including a plurality of generally triangular shaped stub fingers attached along said intitially encountered aperture edge in perpendicular relation to said disc common axis, each said stub finger being positioned so that the upper edge thereof is parallel to the surface of said floor plate and extends from said horizontal floor plate to the periphery of the arc of rotation of said hammers for preventing dense clumps of material from wedging between said discs and said enclosing arcuate screen.

10. In an apparatus in accordance with claim 9, the rotary motion of said discs causing said hammers to arc above the surface of said floor plate in a direction opposite the direction of travel of the materials in response to rotation of the container, a guide plate attached to the edge of said aperture opposite said edge initially encountered by the materials, said guide plate being oriented for preventing materials expelled from said aperture by said hammers from escaping from the container.

* * * * *

UNITED STATES PATENT OFFICE

CERTIFICATE OF CORRECTION

Patent No. 4,033,515 Dated 5 July 1977

Inventor(s) Ernest A. Barcell; James L. Pusch

It is certified that error appears in the above-identified patent and that said Letters Patent are hereby corrected as shown below:

IN THE SPECIFICATION:

Column 1, line 62, cancel "Barcel" and substitute -- Barcell --

Column 3, line 21, cancel "tube" and substitute -- tub --.
line 28, cancel "tube" and substitute -- tub --.
line 39, cancel "tube" and substitute -- tub --.
line 42, cancel "tube" and substitute -- tub --.

Column 4, line 5, cancel "tube" and substitute -- tub --.
line 7, cancel "tube" and substitute -- tub --.
line 19, cancel "tube" and substitute -- tub --.
line 20, cancel "rotationary" and substitute -- rotational --.

Column 5, line 29, cancel "6" and substitute -- 5 --.
line 56, cancel "area" and substitute -- areas --.

UNITED STATES PATENT OFFICE

CERTIFICATE OF CORRECTION

Patent No. 4,033,515 Dated 5 July 1977

Inventor(s) Ernest A. Barcell; James L. Pusch

It is certified that error appears in the above-identified patent and that said Letters Patent are hereby corrected as shown below:

Column 6, line 12, cancel "Preferbly" and substitute -- Preferably --.
line 20, cancel "tube" and substitute -- tub --.

Column 7, line 14, cancel "is" and substitute -- it --.
line 24, cancel "includs" and substitute -- includes --.

Signed and Sealed this

First Day of November 1977

[SEAL]

Attest:

RUTH C. MASON
Attesting Officer

LUTRELLE F. PARKER
Acting Commissioner of Patents and Trademarks